United States Patent [19]

Claar et al.

[11] Patent Number: 5,050,410

[45] Date of Patent: Sep. 24, 1991

[54] LOCKING DEVICE FOR MOTOR VEHICLES WITH SLEEVE-ACTUATED SWITCH

[75] Inventors: Klaus Claar, Sindelfingen; Hans Deischi, Jettingen; Kurt Raffelsiefer, Velbert, all of Fed. Rep. of Germany

[73] Assignee: Daimler-Benz AG, Stuttgart, Fed. Rep. of Germany

[21] Appl. No.: 651,042

[22] Filed: Feb. 4, 1991

Related U.S. Application Data

[63] Continuation of Ser. No. 393,230, Aug. 14, 1989, abandoned.

[30] Foreign Application Priority Data

Aug. 13, 1988 [DE] Fed. Rep. of Germany ..... 3827564

[51] Int. Cl.[5] ..... E05B 65/36

[52] U.S. Cl. ..... 70/237; 70/255; 70/264; 70/DIG. 42; 200/553

[58] Field of Search ..... 70/264, DIG. 42, 237, 70/222, 254, 255, 257, 422; 292/DIG. 62; 200/553

[56] References Cited

U.S. PATENT DOCUMENTS

| | | | |
|---|---|---|---|
| 1,159,635 | 11/1915 | Wolfe et al. | 70/DIG. 42 X |
| 1,549,603 | 8/1925 | Murmann | 70/DIG. 42 X |
| 2,996,910 | 8/1961 | Willis | 70/264 |
| 3,000,204 | 9/1961 | DeVito | 70/264 |
| 3,751,950 | 8/1973 | Leger et al. | 70/264 |
| 4,300,374 | 11/1981 | Mullich et al. | 70/DIG. 42 X |
| 4,550,580 | 11/1985 | Neyret | 70/379 R X |
| 4,689,977 | 9/1987 | Wolniak et al. | 70/379 R |

FOREIGN PATENT DOCUMENTS

| | | | |
|---|---|---|---|
| 2522301 | 12/1976 | Fed. Rep. of Germany | 70/264 |
| 2152613 | 8/1977 | Fed. Rep. of Germany . | |
| 312022 | 12/1982 | Fed. Rep. of Germany . | |
| 3513555 | 11/1986 | Fed. Rep. of Germany | 70/264 |
| 3628376 | 2/1988 | Fed. Rep. of Germany . | |
| 188105 | 3/1964 | Sweden | 70/237 |

*Primary Examiner*—Lloyd A. Gall

*Attorney, Agent, or Firm*—Evenson, Wands, Edwards, Lenahan & McKeown

[57] ABSTRACT

The invention relates to a vehicle locking device having a mechanical rotary connection between a cylinder core of a lock cylinder and a lever system of an associated lock and comprises a driver coupling having two sleeve bodies which are mounted coaxially to one another and, in their installed position, are positively coupled to one another with the interposition of a rotary lost motion freewheeling connection. The rotary movement of the sleeve body drivable by the cylinder core, via a rotary connection element, is sensed for the purpose of controlling an additional locking function superposed on the rotation of the cylinder core. The other sleeve body is dynamically coupled to a securing element of the lever system of the lock. In order to achieve a substantial freedom in the arrangement of the control elements, the two sleeve bodies are rotatably connected to one another and are independently rotatably mounted on a support, spaced from the lock cylinder. The rotary drive from the cylinder core is connected only to the primarily drivable sleeve body.

10 Claims, 4 Drawing Sheets

LOCKING DEVICE FOR MOTOR VEHICLES WITH SLEEVE-ACTUATED SWITCH

This is a continuation of application Ser. No. 07/393,230, filed Aug. 14, 1989, abandoned.

BACKGROUND AND SUMMARY OF THE INVENTION

The invention relates to a vehicle locking device having a mechanical rotary connection between a cylinder core of a lock cylinder and a lever system of an associated lock comprising a driver coupling with two sleeve bodies which are mounted coaxially to one another and are positively coupled to one another with the interposition of a rotary lost motion freewheeling connection. Rotary movement of the sleeve body, drivable primarily by the cylinder core through a rotary connection, is sensed for the purpose of controlling an additional function superposed on the rotation of the cylinder core. The other sleeve body is coupled to a securing element of the lever system of the associated lock.

A locking device of this general kind is known from German Patent 3,120,222 wherein the lock cylinder forms a constructional unit with the driver coupling and an associated microswitch. This arrangement requires, in the course of assembling or dismantling the lock cylinder, making or breaking the electric cable connections between the microswitch and the wiring of the vehicle, for which purpose corresponding plug-in connections are required. Such plug-in connections become increasingly expensive as more switching lines to electric loads are connected to the microswitch and take up a considerable amount of installation space. However, in the case of current vehicle bodywork vehicle designs, the installation space available for the lock cylinder arrangement in motor vehicle doors is small.

These problems with installation space are exacerbated further if the lock cylinder cannot be mounted on the motor vehicle door by means of a simple push-in movement, but rather requires a transverse thrust in the longitudinal direction of the door on completion of the push-in movement.

In order to be able, during the assembly of the lock cylinder, to obtain a plug-in connection for positive electric contacting, the plug-in connections must participate in the transverse thrust of the lock cylinder as known from German Offenlegungsschrift 3,628,376. The sliding range of the contacting elements is thus also lost as installation space. Here one finds a mechanical rotary connection between a cylinder core of a lock cylinder and a lever system of an associated lock. The connection comprises a rotary torsion bar connection which can be plugged into a sleeve-shaped coupling element in the course of the assembly of the lock cylinder. The coupling element comprises a one-piece plastic sleeve which is mounted rotatably on the lock plate and is dynamically coupled to the lever system. The plug-in connection between the driver wings of the torsion bar and the driver opening in the coupling element also exhibits a rotary return play which is present for returning the cylinder core into its key withdrawal position.

However, in this known rotary connection, no sensing of the rotary lock movement for controlling an additional function is provided.

The object on which the invention is based is to further develop a locking device of the above general type for motor vehicles, in such a way that, despite the sensing of its rotary movement for the purpose of controlling an additional function, the lock cylinder can be of very compact design.

This object is achieved by having one of the two sleeve bodies of the driver coupling, attached rotatably to the other corresponding sleeve body and with the driver coupling rotatably mounted on a support component independently of the lock cylinder, and wherein the rotary connection means of the cylinder core is connected only to the primarily drivable sleeve body. This arrangement provides a substantial freedom with regard to the arrangement of the driver coupling and the elements sensing its rotation then is now available. To establish the rotary connection between lock cylinder core and driver coupling, it is possible to use a conventional torsion bar which can be pushed into the driver coupling during the assembly of the lock cylinder.

Sensing elements associated with the driver coupling can be fitted in their functional position on the bodywork, so that in the case of electric switching contacts or the like, fixed cable connections to the wiring of the vehicle become possible. Furthermore, plug-in connections for positive electric contacting in the course of the assembly of the lock cylinder are also superfluous, a clear constructional simplification thereby being obtained.

The rotary key-return play of the lock core can advantageously be combined with the rotary securing play into a common rotary freewheeling play. In this case, the torsion bar can be connected without rotary play to the primarily drivable sleeve body, thus ensuring an absolutely synchronous rotation of the sensed sleeve body with the cylinder core.

In order to make possible a flat arrangement of a microswitch on a bodywork panel, or on a wall of the lock plate next to the sensed sleeve body, a track curve is provided on the outer periphery of the sensed sleeve body by the trip contact. The track curve is preferably formed integrally on the sleeve body.

In addition, a driver coupling which is light and can be produced at a favorable price is obtained if the two sleeve bodies are in each case injection-moulded in one piece from plastic and can be snapped together by means of a clip connection so that one sleeve body is mounted rotatably on the other sleeve body. The sleeve body pair can thus be mounted as a whole at the bodywork or at the lock plate by connection with one of the sleeve bodies.

A particularly compact structure of the driver coupling is obtained if the driver connection, provided with rotary securing play, is integrated into the interior of the driver coupling.

Other objects, advantages and novel features of the present invention will become apparent from the following detailed description of the invention when considered in conjunction with the accompanying drawings.

DETAILED DESCRIPTION OF THE DRAWINGS

Figure 1:
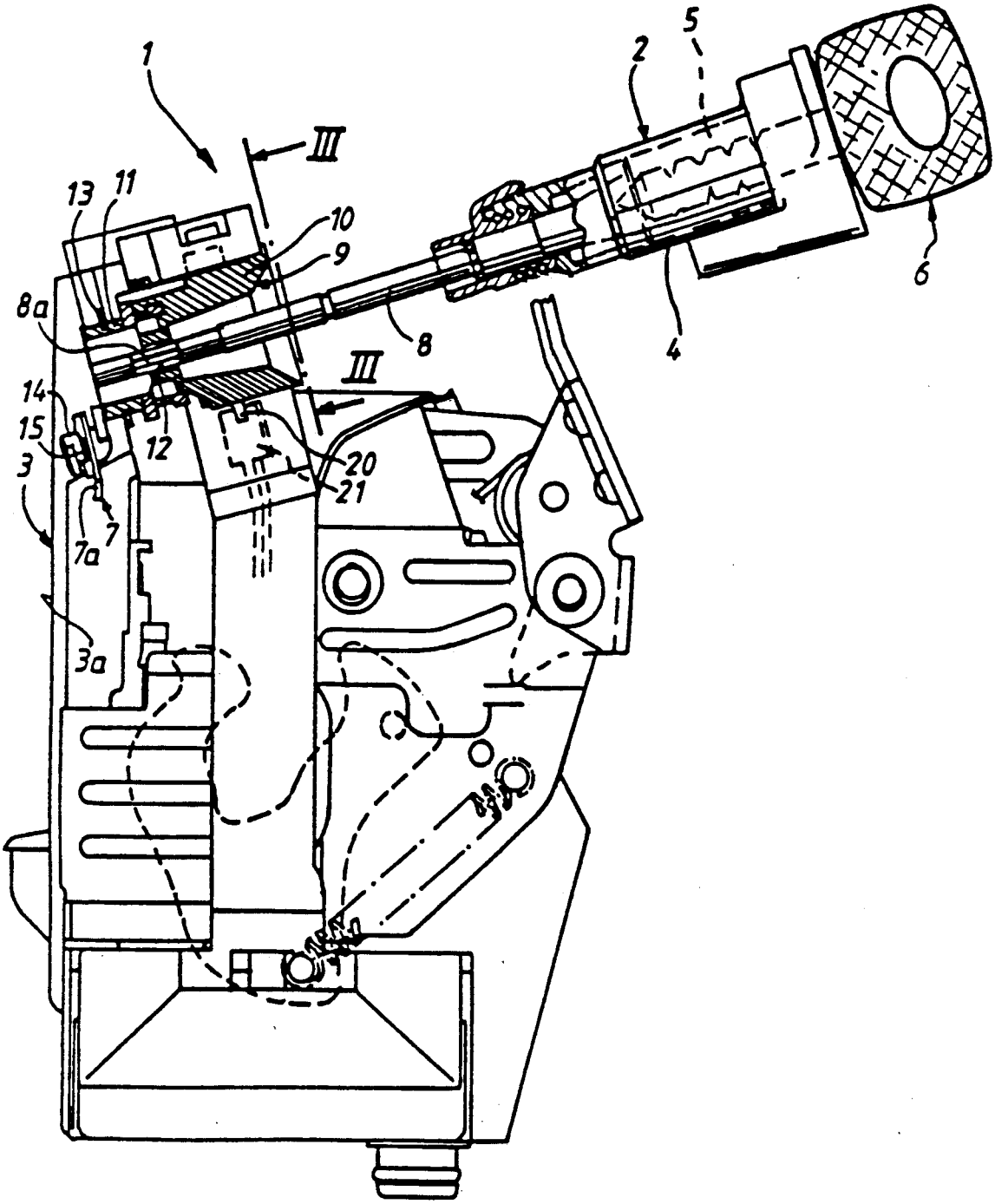
FIG. 1 shows an arrangement of a locking device seen in the transverse plane of a motor vehicle door.

FIG. 1 shows a locking device 1 for a motor vehicle door (not shown) assembled in its installed position. Its principal components are a lock cylinder 2 and a lock 3. The lock cylinder 2 comprises the customary cylinder housing 4 in which a cylinder core 5 is mounted so as to be rotatable as long as an associated key 6 has been inserted into a key channel of the cylinder core 5. The key 6 is in its single key-withdrawal position and can thus be withdrawn from the key channel of the cylinder core 5. As a result, tumbler plates arranged in the cylinder core 5 emerge radially from the latter under a spring loading and engage in associated blocking channels recessed out of the cylinder housing 4. The cylinder core 5 then lies locked in the cylinder housing 4, i.e. it is blocked against rotation.

An inserted key 6 can be rotated together with the cylinder core 5 by 75° in the clockwise direction or in the anticlockwise direction, the security positions of the lock 3 thereby being mechanically controlled.

After the release of the key 6, the cylinder core 5 snaps back automatically into its key-withdrawal position under a torsion-spring loading of the cylinder core 5 relative to the cylinder housing 4. The security positions of the lock 3 must thus be locked by the lever system of the lock 3. This is possible by swivelling a securing lever 7 belonging to the lever system in an opposite direction.

Since the lock cylinder 2 is arranged spatially separated from the lock 3, a torsion bar 8 is articulatedly connected and rotatably fixed to the cylinder core 5 so that rotary movement of the bar 8 can be converted at the lock 3 into a swivelling movement of the securing lever 7 which thus acts as an extension of cylinder core 5. For the purpose of said conversion, a driver coupling 9, which comprises two sleeve bodies 10 and 11, is mounted rotatably on the lock plate 3a.

In the course of the assembly of the lock cylinder 2, the torsion bar 8 can be inserted into a clear ring cross-section of the driver coupling 9 to be rotationably and fixedly connected to the sleeve body 10 via a plug-in connection. The torsion bar 8 has two wings 8a arranged diametrically therewith. The wings engage positively in a matching plug-in opening 12, recessed in the base of the sleeve body 10. To ensure that the sleeve body 10 can only rotate together with the sleeve body 11 after passing through a rotary securing play, the sleeve body 10 is mounted with corresponding rotary freewheeling lost motion play on a peripheral surface of the sleeve body 11 and held axially as will be explained in greater detail later on in the text.

For the rotary mounting of the driver coupling 9 in the lock plate 3a, a bearing shaft of the sleeve body 11 passes through a bore in the lock plate 3a and is fixed axially by means of a retaining ring 13, which is situated opposite a stop shoulder of the bearing shaft on the other side of the bore.

Movement of the sleeve body 11 is coupled to the securing lever 7 in such a way that rotation of the sleeve body 11 is converted into a pivoting movement of the securing lever 7. For this purpose, an extension pin 14 projects eccentrically from a sleeve body 11 end face which has passed through a bore in the lock plate 3a. The pin 14 extends approximately axially and parallel to the torsion bar 8 as an extension of the latter and passes through a slot 15 in an extension arm 7a of the securing lever 7.

Figure 2:
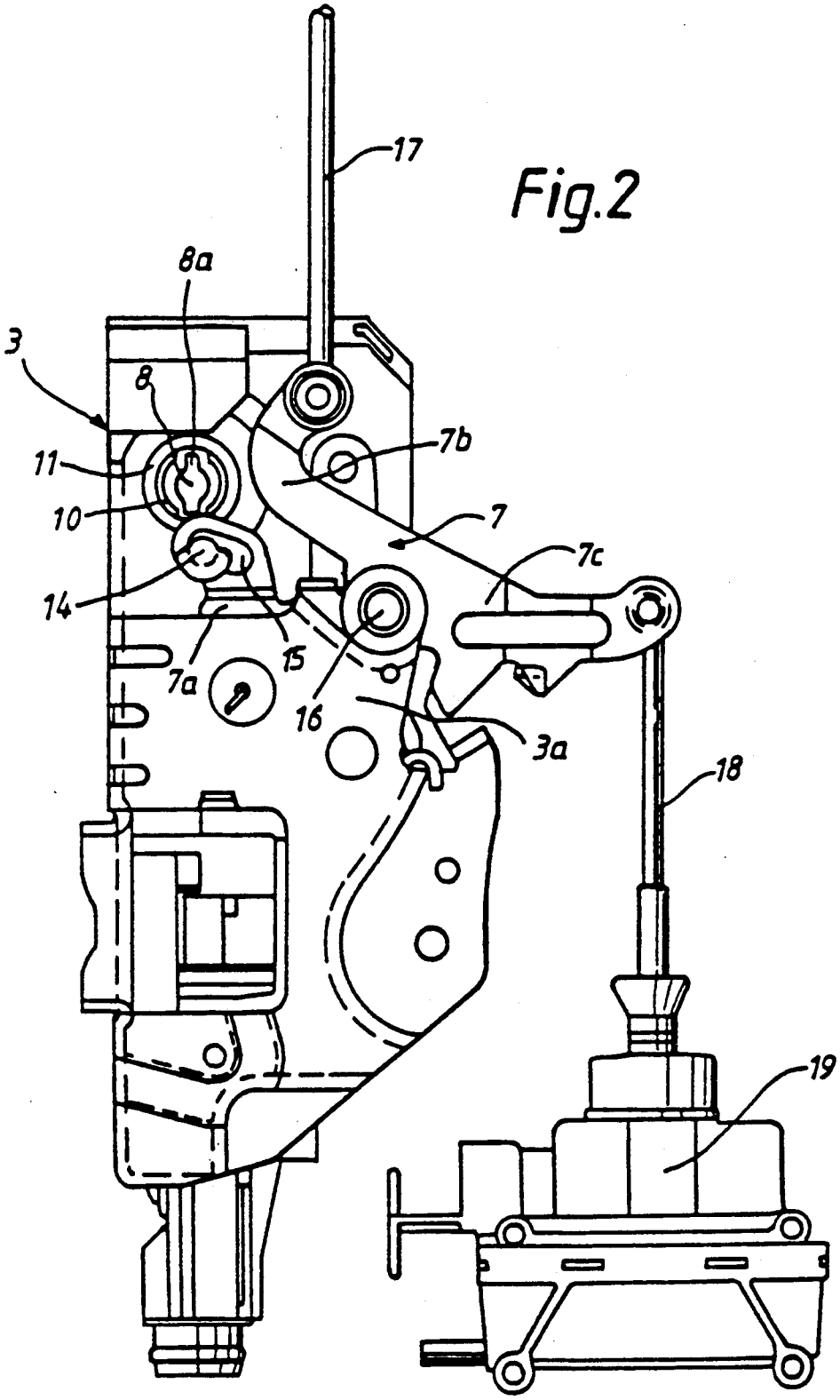
FIG. 2 shows a view of the lock according to FIG. 1 seen from the inner side of the motor vehicle door.

As can be seen in FIG. 2, the securing lever 7 has two further lever arms 7b and 7c and is mounted centrally to pivot about a bearing pin 16 on the lock plate 3a. The security state of the lock 3 can thus be changed either via the advance of the connecting rods 17 or 18, or via a corresponding annular movement of the sleeve body 11, since the securing lever 7 is pivoted to on of the two end positions in which it is locked. These end positions correspond to the secured or unsecured locking conditions of the lock 3.

The locking device 1 represents one component of a central locking system. Other locking devices make it possible to remotely control elements of the locking systems by rotation of the key in the lock cylinder 2. For this purpose, in certain rotational positions of the cylinder core 5, a double-acting pump (not shown) must be switched to supply all central locking elements 19 alternately with a vacuum or pressure source. It is thereby possible for the remote controlled locks to be changed via movement of connecting rods 18.

In order to be able to control the additional function superposed on the mechanical rotary actuation of the cylinder core 5, the rotational position of the sleeve body 10 (fixedly connected in terms of rotation, via the torsion bar 8 to the cylinder core 5) is sensed by a switching contact 20 of a microswitch 21. This microswitch 21 is attached to the lock plate 3a at the periphery of the sleeve body 10. The switching contact 20 rests against the periphery of the sleeve body 10.

Figure 3:
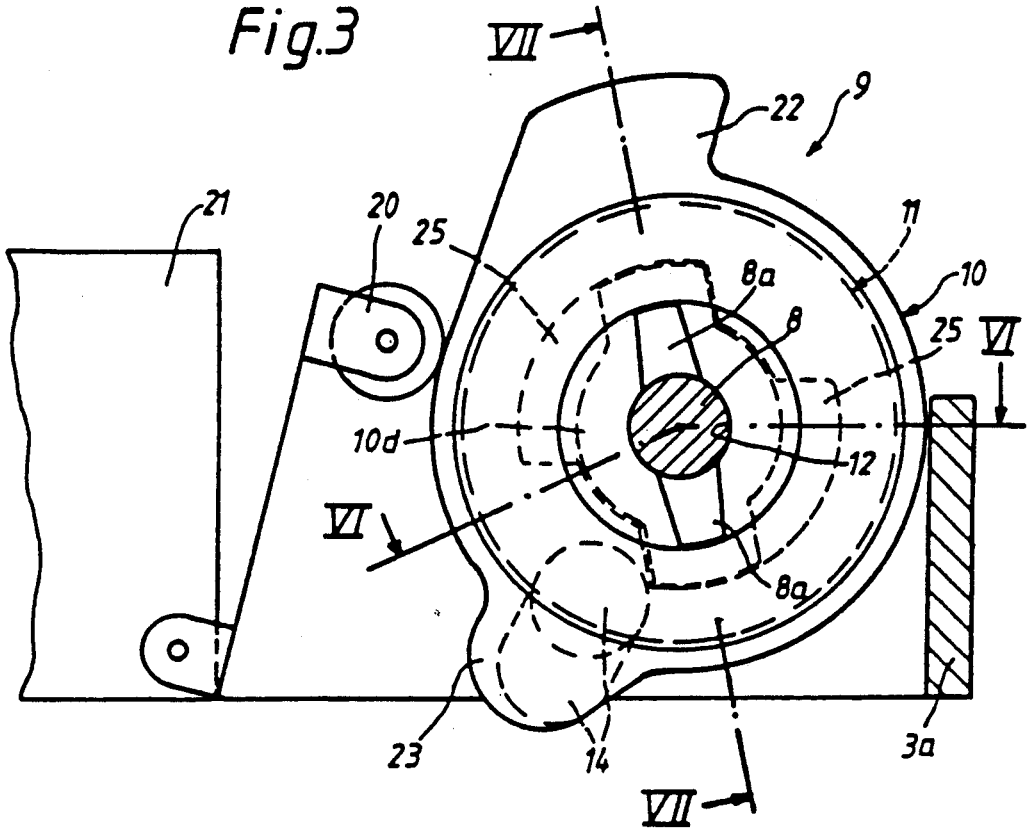
FIG. 3 shows a section view of the lock along the line III—III in FIG. 1 in a starting position of the driver coupling.

As seen FIG. 3, two trip cams 22 and 23 project radially from the sleeve body 10 and define a peripheral curved track of the sleeve body 10 between them. The switching contact 20, designed as a switching roller, runs along this track curve. Switching is triggered via the microswitch 21 as soon as the switching contact 20 is pressed sufficiently inwards, counter to its spring loading, towards the microswitch 21 by means of the trip cams 22 and 23.

Figure 6:
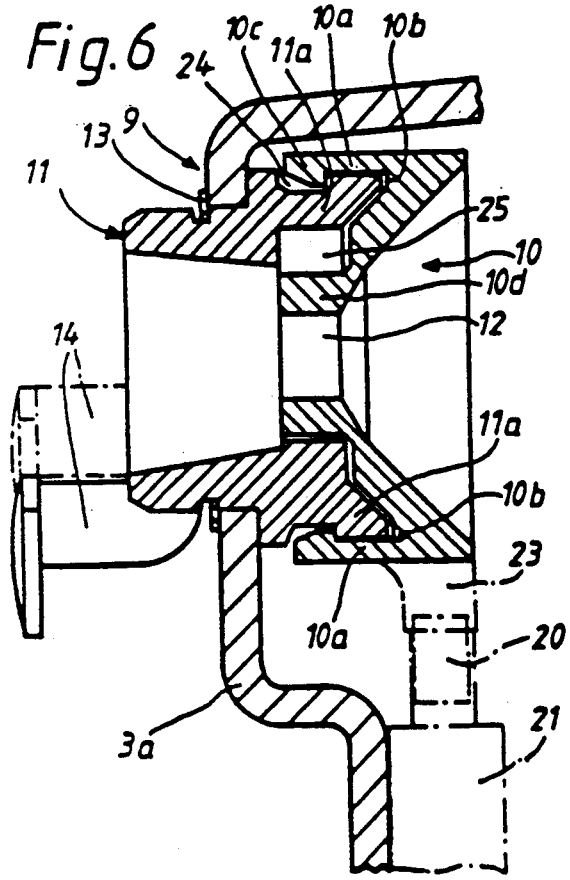
FIG. 6 shows a section through the driver coupling in accordance with the line VI—VI in FIG. 3.
Figure 7:
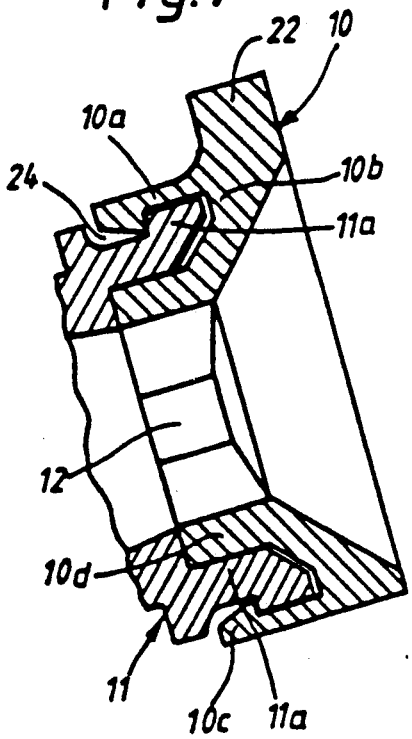
FIG. 7 shows a section through the driver coupling along the line VII—VII in FIG. 3.

The further structure of the driver coupling 9 can be clearly seen in FIGS. 6 and 7. The sleeve bodies 10 and 11 each have a ring portion 10a and 11a by means of which they can be pushed one onto the other in a telescope-fashion, whereupon ring portion 10a becomes rotatably mounted on the corresponding ring portion 11a. The axial advance of ring portion 10a on ring portion 11a is limited in the push-in direction by having a ring end face, at one end of ring portion 11, abut a circumferential shoulder 10b internally of sleeve body 11. The shoulder 10b is formed integrally on one end of ring portion 10a and extends radially inwards from the latter. A circumferential clip hook 10c, formed integrally on the opposite end of ring portion 10a, is directed radially inwards. With ring portion 10a pushed on, the clip hook 10c engages in an annular groove 24 opening radially outwards from the outer periphery of ring portion 11a. As a result, a swivel seat is produced between the clip hook 10c and the shoulder 10b which provides an expanding joint that is secured against axial sliding. This swivel seat is possible because of the elasticity of the plastic. Instead of a circumferential clip hook 10*c*, it is also possible to utilize a plurality of clip hooks 10*c* distributed over the periphery of the ring portion 10*a*. A plurality of hooks make snapping together of this ring portion easier.

Adjoining the shoulder 10*b*, the sleeve body 10 increasingly tapers to produce a funnel-shaped centering opening. In this arrangement, starting from the shoulder 10*b*, the sleeve body extends into the clear cross-section of the sleeve body 11 where it ends approximately centrally of the latter in a funnel base where the plug-in opening 12 is located. The peripheral contour of the funnel base, which corresponds to that of a double-bit key as seen in cross-section, forms a driver cam 10*d*. A corresponding driver opening 25 is recessed out of the inner periphery of the ring portion 11*a* in the transverse plane of the driver cam 10*d*. This opening is matched to the diameter of the driver cam 10*d*. To ensure that a relative rotation exists between the sleeve bodies 10 and 11, beyond the desired rotary freewheeling play, the driver opening 25 is over-dimensioned, being widened in the manner of a dovetail.

By virtue of the structure of the driver coupling 9, the following movement sequence of the locking members is produced, starting from the zero locking position according to FIG. 3.

Figure 4:
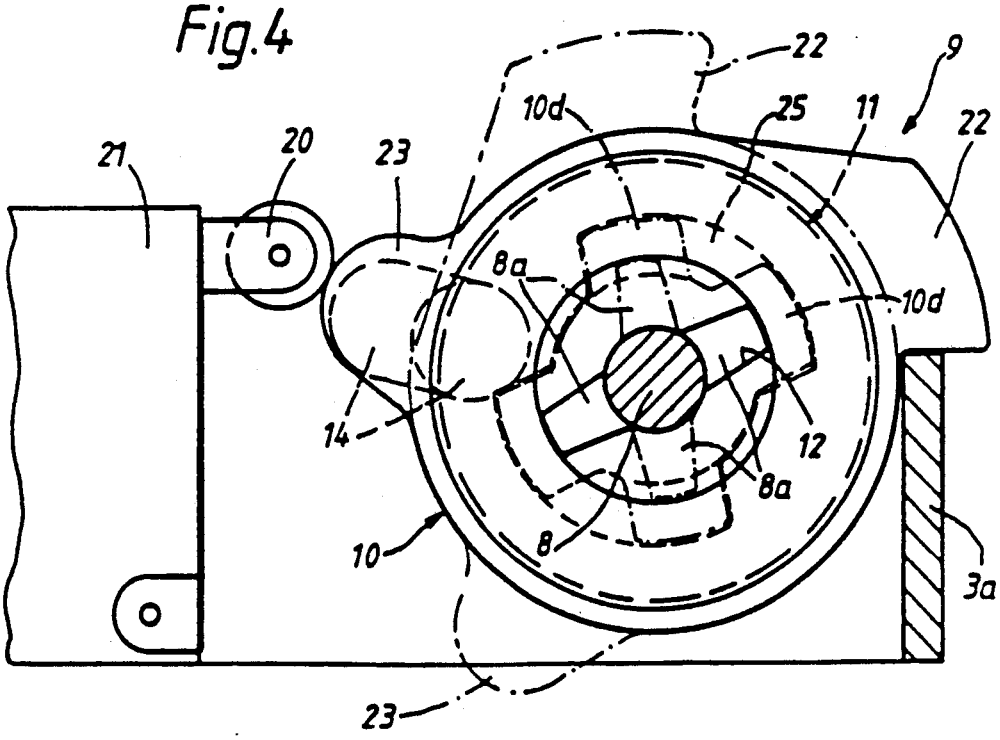
FIG. 4 shows the driver coupling according to FIG. 3 in the secured condition.

In order to secure the lock 3, the cylinder core 5 is rotated by 75° in the clockwise direction starting from its key withdrawal position. The torsion bar 8 is thereby rotated synchronously with it. Since the plug-in connection (between the torsion bar 8 and the plug-in opening 12 in the driver cam 10*d*) is substantially without play, the driver cam 10*d* rotates with rotary movement of the cylinder core 5. As a result, the entire sleeve body 10 rotates by a corresponding angle. Since the driver cam 10*d* is also supported against its direction of rotation in the driver opening 25, the sleeve body 11 is also rotated with the result that the extension pin 14 connected to it moves along a circular path. In the process, by reason of its combined rotary and sliding articulation with respect to the extension pin 14, the securing lever 7 is pivoted until after an angle of rotation of 55° of the sleeve body 11, it has assumed its secured locking position. Upon further rotation of the sleeve body 11, the lever arm 7*a* no longer takes part in the upward directed movement of the extension pin 14 but rather there is relative sliding in an idle stroke along the slot 15. From an angle of rotation of about 65° onwards, the hyperfunction is actuated. As can be seen from FIG. 4, in this range, the trip cam 23 is in a rotational position in which the switching contact 20 has been positioned against the microswitch 21 to trigger switching. After travelling through the entire actuating angle of rotation, the sleeve body 10 is blocked against further rotation since the second trip cam 22 strikes a stop 3*a* of the lock plate 3.

If after this securing procedure the key is released, the cylinder core 5 snaps back into its key withdrawal position and the torsion bar 8 together with the sleeve body 10 connected thereto is rotated back. However, sleeve body 11 does not take part in this return rotation. Instead, the driver cam 10*d* rotates back freely by 75° (in the driver opening 25) with respect to the sleeve body 11 after which, as illustrated by broken lines, it rests against the opposite plane of the driver opening 25. The rotary key-return play is thus taken up by the rotary freewheeling play of the driver coupling 9.

Figure 5:
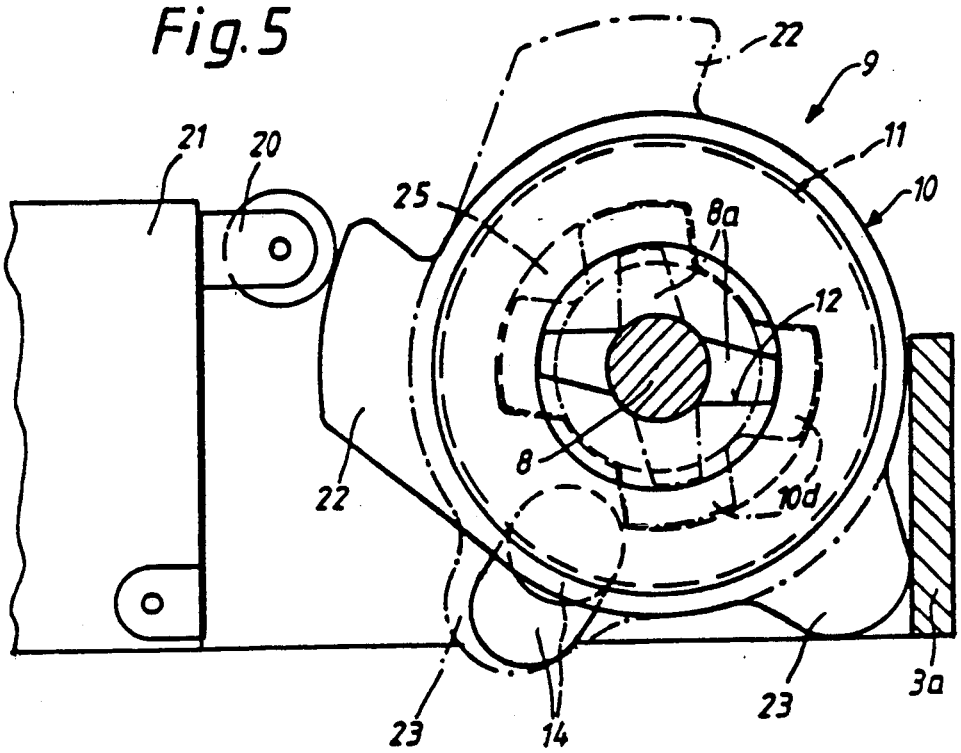
FIG. 5 shows the driver coupling according to FIG. 3 in the unsecured position.

To release the secured locking device 1, the cylinder core 5 must be rotated out of its key withdrawal position by an angle of about 75° in the anticlockwise direction, as can be seen from FIG. 5. During this procedure, the rotation of the cylinder core 5 is likewise transmitted via a play-free rotary connection since, in the position into which it has rotated back, the driver cam 10*d* abuts in the driver opening 25, as a result of which the sleeve body 11 is taken along synchronously. In the course of the rotation on the sleeve body 10, the hyperfunction is actuated before the mechanical releasing procedure starts. For this purpose, the switching contact 20 of the microswitch 21 is brought into its operating position by means of the second trip cam 22 and held in this operating position over the further rotational path of the sleeve body 10. After reaching the switching point, which follows an angle of rotation of the sleeve body 10 of about 45°, the mechanical releasing procedure starts, the securing lever 7 being unlocked. While, before the releasing procedure, the extension pin 14 of the sleeve body 11 is initially moved without having any effect in the slot 15, it subsequently exerts a transverse thrust on the lever arm 7*a*. By virtue of the transverse thrust, the lever arm 7*a* takes part in the downward-directed movement of the extension pin 14 until the mechanical locking of the securing lever 7 is released. The unlocking thrust here extends over an angle of rotation of the sleeve body 11 of about 10°, after which the securing lever 7 is automatically pivoted further and into its unsecured position under a spring loading.

After an angle of rotation of about 75°, the sleeve body 10 is blocked against further rotation since its trip cam 23 now strikes the lock plate 3*a*. If the key 6 is released, the cylinder core 5 automatically rotates back into the key withdrawal position and the sleeve body 10 is thereby also rotated. In the course of this return rotation, the driver cam 10*d* resumes its starting position in the driver opening 25, since the driver opening 25 offers the necessary rotary return play. The unsecured position of the lock 3 is thus retained.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A vehicle locking device having a mechanical rotary connection between a cylinder core of a lock cylinder and a lock lever system of an associated lock to effect a mechanical rotary actuation function, comprising:

a driver coupling having two sleeve bodies which are mounted coaxially to one another and are positively coupled to one another through interposition of a rotary lost motion connection, the cylinder core providing rotary movement of one of the sleeve bodies via a rotary connection for controlling an additional function superposed on the rotary actuation function of the cylinder core;

the other sleeve body being rotatable by the cylinder core through the one sleeve body and the lost motion connection, and being dynamically coupled to a securing element of the lever system for actuating the associated lock;

the two sleeve bodies of the driver coupling being rigidly mounted on a support component, independently of the lock cylinder; and the rotary connection of the cylinder core is connected only to the one sleeve body, wherein circumferentially spaced trip cams project radially from the one sleeve body and define a curved track for controlling a microswitch with a switching contact scanning the rotary movement of the one sleeve body along the track, with the circumferential spacing between the cams being sufficient to permit the securing element of the lever system to take up multiple stable end positions at which the cams prevent further movement of the one sleeve body.

2. A locking device according to claim 1, wherein the rotary lost motion connection causes relative rotation between the sleeve bodies upon a rotary key-return of the cylinder core without causing a lever of the lock lever system to release the lock; and wherein the rotary connection is connected virtually free of rotary play to the one of the sleeve bodies.

3. A locking device according to claim 1, wherein the associated lock is spaced from the cylinder core;

wherein the space between the cylinder core and the lock is bridged by the rotary connection; and wherein the driver coupling is mounted at the lock.

4. A locking device according to claim 2, wherein the associated lock is spaced from the cylinder core;

wherein the space between the cylinder core and the lock is bridged by the rotary connection; and wherein the driver coupling is mounted at the lock.

5. A locking device according to claim 1, wherein the trip cams are formed integrally on a peripheral wall of the one sleeve body.

6. A locking device according to claim 1, wherein the two sleeve bodies of the driver coupling each have a ring portion;

the ring portions being telescoped together to form a telescope connection for mutual rotary mounting; and wherein the corresponding ring portions are telescopically fixed together by axial securing means.

7. A locking device according to claim 6, wherein the telescope connection provides an overlapping area which is limited by a ring end face of the insertable ring portion abutting an opposite shoulder of the surrounding ring portion;

wherein the axial securing means comprises at least one clip hook portion formed integrally on the surrounding ring portion; and which clip portion can be snapped into an annular groove in an outer periphery of the insertable ring portion.

8. A locking device according to claim 6, wherein the lost motion connection comprises a driver opening in an inner periphery of the insertable ring portion and a driver cam that engages with said driver opening with lost motion; and wherein said driver cam is formed integrally on the surrounding ring portion and extends radially from a ring end face of the surrounding ring portion in an overlapping area.

9. A locking device according to claim 7, wherein the lost motion connection comprises a driver opening in an inner periphery of the insertable ring portion and a driver cam that engages with said driver opening with lost motion; and wherein said driver cam is formed integrally on the surrounding ring portion and extends radially from a ring end face of the surrounding ring portion in the overlapping area.

10. A locking device according to claim 1, wherein the support component is a single plate, and the two sleeve bodies are mounted in the region of one end of the other sleeve body in the plate so that the remainder of the driver coupling extends freely therefrom.

* * * * *